US006516066B2

(12) United States Patent
Hayashi

(10) Patent No.: US 6,516,066 B2
(45) Date of Patent: Feb. 4, 2003

(54) APPARATUS FOR DETECTING DIRECTION OF SOUND SOURCE AND TURNING MICROPHONE TOWARD SOUND SOURCE

(75) Inventor: Kensuke Hayashi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/820,342

(22) Filed: Mar. 29, 2001

(65) Prior Publication Data

US 2001/0028719 A1 Oct. 11, 2001

(30) Foreign Application Priority Data

Apr. 11, 2000 (JP) ..... 2000-109693

(51) Int. Cl.[7] ..... H04R 3/00
(52) U.S. Cl. ..... 381/92; 348/14.1; 379/202.01
(58) Field of Search ..... 381/91, 92, 122; 348/14.08, 14.09, 14.1; 379/202.01

(56) References Cited

U.S. PATENT DOCUMENTS 6,072,522 A * 6/2000 Ipplito et al. ..... 348/14.1

FOREIGN PATENT DOCUMENTS

| | | |
|---|---|---|
| JP | 4-49756 | 2/1992 |
| JP | 4-249991 | 9/1992 |
| JP | 6-351015 | 12/1994 |
| JP | 7-140527 | 6/1995 |
| JP | 9-238374 | 9/1997 |
| JP | 11-41577 | 2/1999 |

* cited by examiner

*Primary Examiner*—Minsun Oh Harvey
(74) *Attorney, Agent, or Firm*—Sughrue Mion, PLLC

(57) ABSTRACT

An object of the present invention is to turn microphones accurately and quickly toward a sound source. The first microphone pair is rotated by rotation means and driving means, so that the microphones are equidistant from a sound source. The sound picked up by the microphones is analyzed in a plurality of frequency ranges to obtain delay time components of the arrival of the sound wave. The delay time components are averaged with a prescribed coefficients so that the lower frequency components hardly affects the result of the direction detection. The averaged delay is converted into an angle of direction of the sound source. Thus, the microphones pair is directed in front of the sound source on the basis of the direction angle converted from the averaged delay time.

6 Claims, 4 Drawing Sheets

130
MICROPHONE
110a
170
110b
MICROPHONE
A/D
210a
A/D
210b
VOICE DETECTION
250
BPF
220a
BPF
220b
MUTUAL CORRELATION
230
INTEGRATION
240
DETECTION MEANS
260
DELAY CALCULATION
270
CONVERSION
280
BPF
220a'
BPF
220b'
MUTUAL CORRELATION
230'
INTEGRATION
240'
DETECTION MEANS
260'

APPARATUS FOR DETECTING DIRECTION OF SOUND SOURCE AND TURNING MICROPHONE TOWARD SOUND SOURCE

BACKGROUND OF THE INVENTION

1. Technical Field of the Invention

The present invention relates to an apparatus for detecting a direction of sound source and an image pick-up apparatus with the sound source detection apparatus, applicable to a video conference and a video phone.

2. Description of the Prior Art

A direction of a narrator in conventional video conference using a plurality of microphones is detected, as disclosed in JP 4-049756 A (1992), JP 4-249991 A (1992), JP 6-351015 A (1994), JP 7-140527 A (1995) and JP 11-041577 A (1999).

The voice from a narrator reaches each of the microphones after each time delay. Therefore, the direction of the narrator or sound source is detected by converting time delay information into angle information.

FIG. 4 is a front view of a conventional apparatus for the video conference, which comprises image input unit 200 including camera lens 103 for photographing a narrator, microphone unit 170 including microphones 110*a* and 110*b*, and rotation means 101 for rotating image input unit 200.

The video conference apparatus as shown in FIG. 4 picks up the voice of the narrator and detects the direction of the narrator, thereby turning the camera lens 103 toward the narrator. Thus, the voice and image of the narrator are transmitted to other video conference apparatus.

FIG. 5 is an illustration for explaining a principle of detecting the narrator direction by using microphones 110*a* and 110*b*. There is a delay between the time when microphone 110*b* picks up the voice of the narrator and the time when microphone 110*a* picks up the voice of the narrator.

The narrator direction angle θ is equal to $\sin^{-1}(V \cdot d/L)$, where V is speed of sound, L is a microphone distance and "d" is a delay time period, as shown in FIG. 5.

However, an accuracy of determining the direction θ is lowered, when the delay and θ becomes great.

Further, the voice of the narrator reflected by a floor and walls is also picked up by the microphones. The background noises in addition to the voice are also picked up. Therefore, the narrator direction may possibly be detected incorrectly.

SUMMARY OF THE INVENTION

An object of the present invention is to provide an apparatus for detecting a direction of a sound source such as a narrator, thereby turning an image pick-up apparatus toward the sound source.

An another object of the present invention is to provide an apparatus for detecting the direction of sound sources which move quickly or are switched rapidly.

A still another object of the present invention is to provide a sound source detection apparatus which is not easily affected by the reflections and background noises.

The apparatus for detecting the direction of sound source comprises a microphone pair, narrator direction detection means for detecting a delay of sound wave detected by the microphones, rotation means for rotating the microphone pair, driving means for driving the rotation means on the basis of the output from the narrator direction detection means, so that the microphone are equidistant from the sound source.

The apparatus for detecting the sound direction of the present invention may further comprises another fixed microphone pair, for turning quickly the rotatable microphone set toward the direction of the sound source.

The narrator direction detection means may comprises mutual correlation calculation means for calculating a mutual correlation between the signals picked up by left and right microphones of the microphone pair, delay calculation means for calculating the delay on the basis of the mutual correlation. Further, the delay may be calculated in a plurality of frequency ranges and averaged with such weights that the lower frequency components are less effective in the averaged result.

According to the variable gain amplifier of present invention, the first microphone pair is turned toward a narrator, so that the sound wave arrives at the microphones simultaneously. Accordingly, the microphone is directed just in front of the sound source.

Further, according to the present invention, the second fixed microphone pair executes a quick turning of the microphone direction. Furthermore, according to the present invention, the direction of the sound source is quickly detected by directing the second microphone set toward the center of the sound sources, when the sound source such as a narrator is changed.

Furthermore, according to the present invention, the detection result is hardly affected by the reflections from floors and walls in the lower frequency range, because the outputs from a plurality of band-pass filters are averaged such that the lower frequency components are averaged with smaller weight coefficients.

PREFERRED EMBODIMENT OF THE INVENTION

Figure 1A:
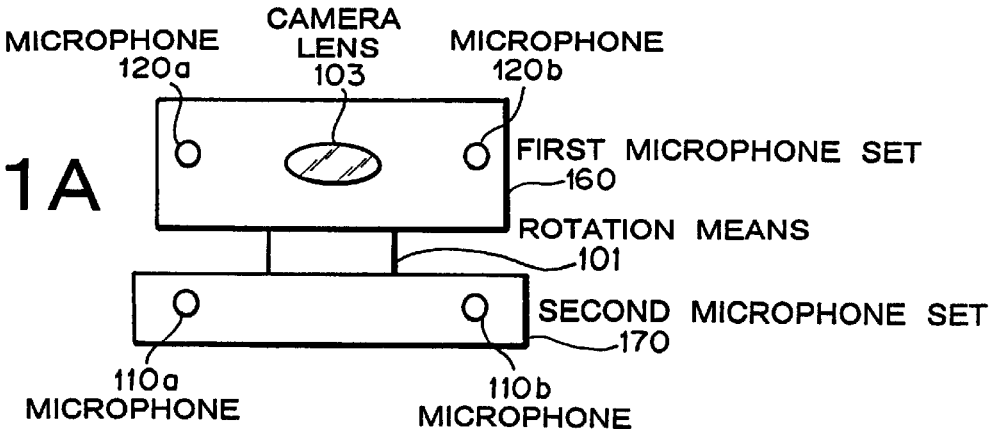
FIG. 1A is a front view of the video conference apparatus of the present invention.

The embodiment of the present invention is explained referring to the drawings.

Figure 1B:
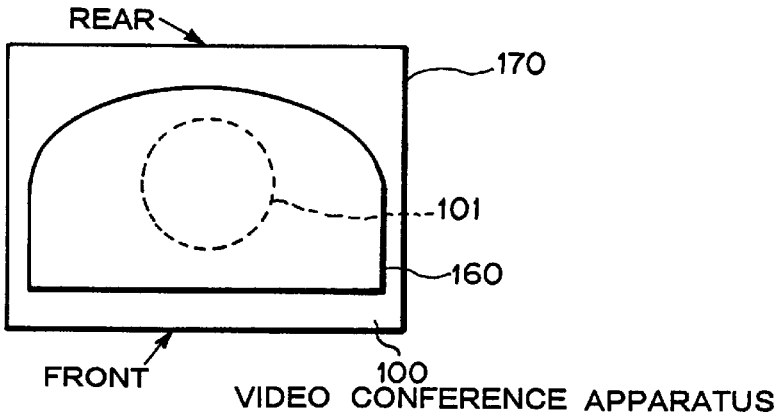
FIG. 1B is a plan view of the video conference apparatus as shown in FIG. 1 of the present invention.

FIG. 1A is a front view of a video conference apparatus provided with the apparatus for detecting the sound source direction of the present invention. FIG. 1B is a plan view of the video conference apparatus 100 as shown in FIG. 1A.

The video conference apparatus as shown in FIG. 1A comprises camera lens 103 for photographing the narrator, microphone set 160 including microphones 120*a* and 120*b*, microphone set 170 including microphones 110*a* and 110*b*, and rotation means 101.

Microphones 110*a*, 110*b*, 120*a* and 120*b* may be sensitive to the sound of 50 Hz to 70 kHz.

Figure 1C:
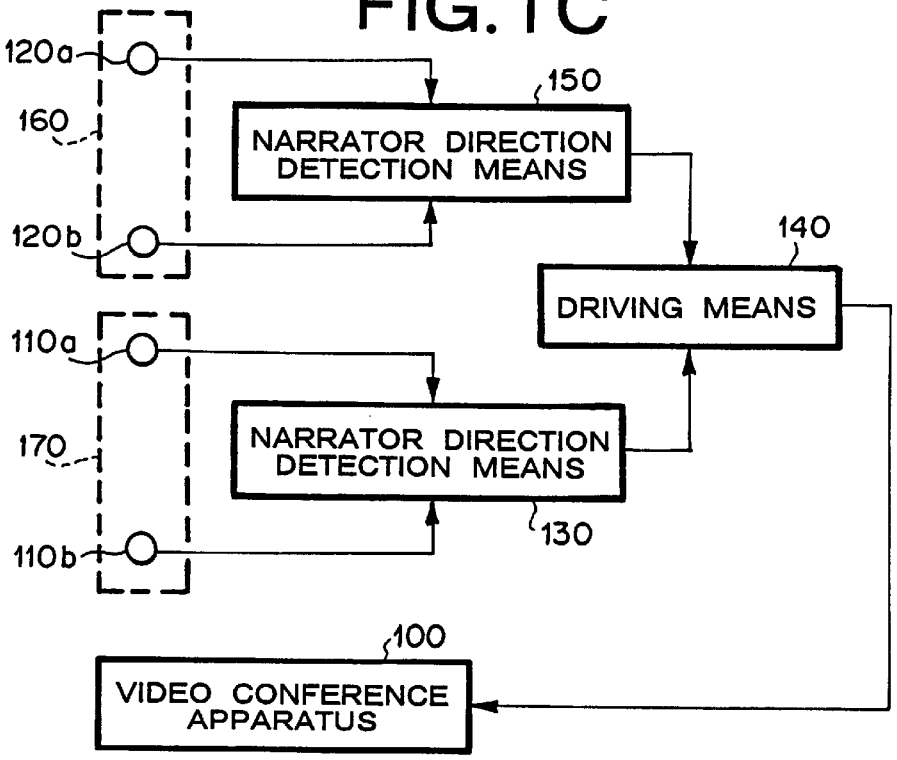
FIG. 1C is a block diagram of the narrator direction detection means and microphone rotating means for the video conference apparatus as shown in FIG. 1A.

FIG. 1C is a block diagram of a detection system for detecting the direction of narrators. There are shown in FIG. 1C, narrator direction detection means 130 using microphone set 170, narrator direction detection means 150 using microphone set 160, driving means 140 for driving rotation means 101. Driving means 140 feeds information of the narrator direction detected by narrator direction detection means 130 and 150 back to video conference apparatus 100.

Figure 2:
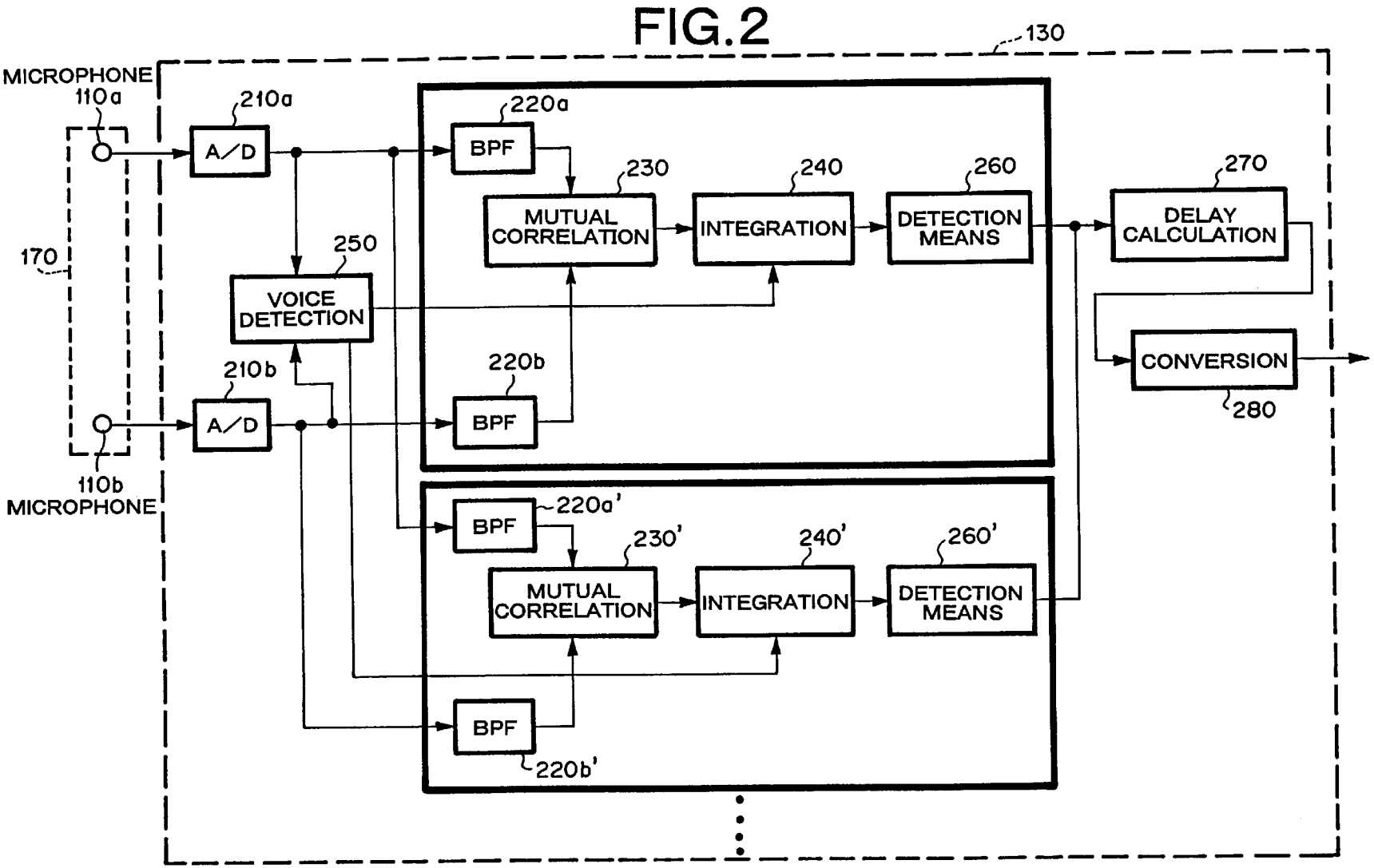
FIG. 2 is a detailed block diagram of the narrator direction detection means as shown in FIG. 1C.

FIG. 2 is a block diagram of microphone set 170 and narrator direction detection means 130. There are shown in FIG. 2, A/D converters 210*a* and 210*b* for sampling the voice picked up by microphones 110*a* and 110*b* under the sampling frequency, for example, 16 kHz, and voice detection means for determining whether or not the signals picked up by microphones 110*a* and 110*b* are the voice of the narrator.

Further, there are shown in FIG. 2 band-pass filters 220*a*, 220*b*, 220*a*', 220*b*', calculation means for calculating a mutual correlation between the signal from microphone 110*a* and the signal from microphone 110*b*, integration means 240 and 240' for integrating the mutual correlation coefficients, and detection means 260 and 260' for detecting a delay between microphone 110*a* and microphone 110*b* which maximizes the integrated mutual correlation coefficients.

Band-pass filters 220*a* and 220*b* pass, for example, 50 Hz to 1 kHz, while band-pass filters 220*a*' and 220*b*' passes, for example, 1 kHz to 2 kHz. Two sets of band-pass filters (220*a*, 220*b*) and (220*a*', 220*b*') are shown in FIG. 2. A plurality of more than two sets of band-pass filters, for example, 7 sets, may be included in narrator direction detection means 130. In this case, each of not-shown band-pass filters passes, 2 kHz to 3 kHz, . . . , 6 kHz to 7 kHz, respectively.

Furthermore, there are shown in FIG. 2 delay calculation means 270 for calculating the delay between microphone 110*a* and microphone 110*b* on the basis of prescribed coefficients, and conversion means for converting the calculated delay into an angle. Here, the delay is a time difference between a time when said sound wave arrives at a microphone and a time when said sound wave arrives at another microphone in a microphone pair.

Narrator direction detection means 150 is similar to narrator direction detection means 130.

In the video conference apparatus as shown in FIGS. 1A, 1B, 1C and 2, the voice of the narrator is picked up by microphones 11*a* to 120*b* and inputted into narrator direction detection means 130 and 150. The inputted voice is converted into digital signal by A/D converters 210*a* and 210*b*. The digital signal is inputted simultaneously into voice detection mean 250, band-pass filters 220*a*, 220*b*,220*a*', 220*b*'.

Each of the seven sets of band-pass filters passes only its proper frequency range, for example, 50 Hz to 1 kHz, 1 kHz to 2 kHz, 2 kHz to 3 kHz, . . . , 6 kHz to 7 kHz, respectively.

The outputs from the band-pass filters are inputted into calculation means 230, 230', . . . In this example, there are seven calculation means for calculating the mutual correlation coefficients between signals inputted into the calculation means. Then, the calculated mutual correlation coefficients are integrated by integration means 240, 240', . . . .

On the other hand, voice detection means 250 determines whether or not the picked-up sound human voice. The determination result is inputted into integration means 240, 240', . . . Then, the integration means output the integrated mutual correlation coefficients toward detection means 260, 260', . . . when the picked-up signal is human voice. On the contrary, the integration means clear the integrated mutual correlation coefficients, when the sound picked-up by microphones 110*a* and 110*b*.

Figure 3:
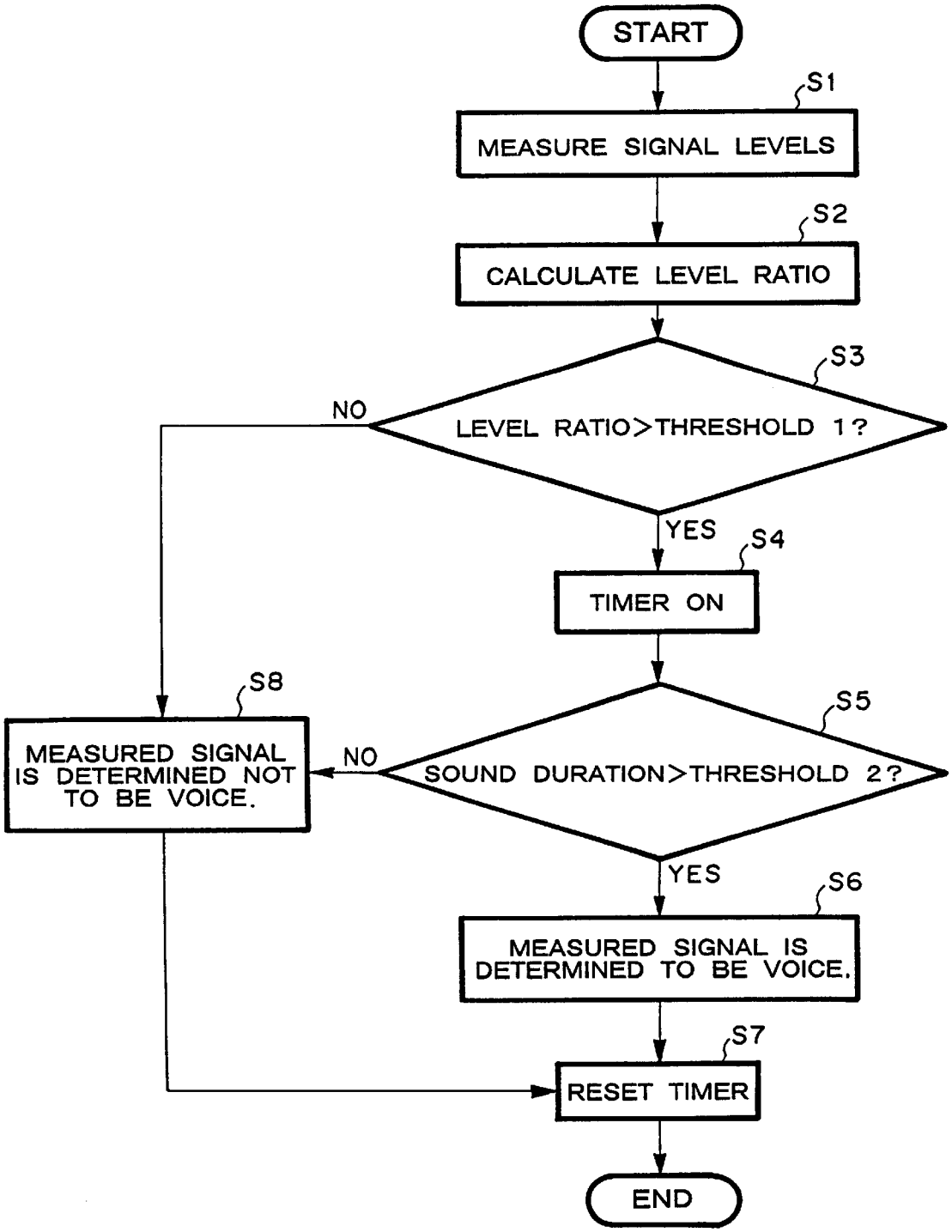
FIG. 3 is a flow chart for explaining a method for detecting the sound source.
Figure 4:
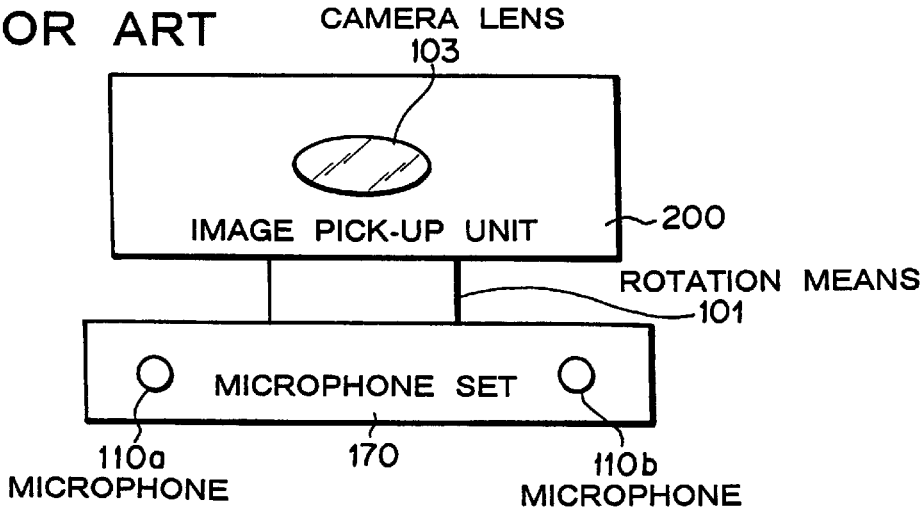
FIG.4 PRIOR ART
FIG. 4 is a block diagram of a conventional video conference apparatus.
Figure 5:
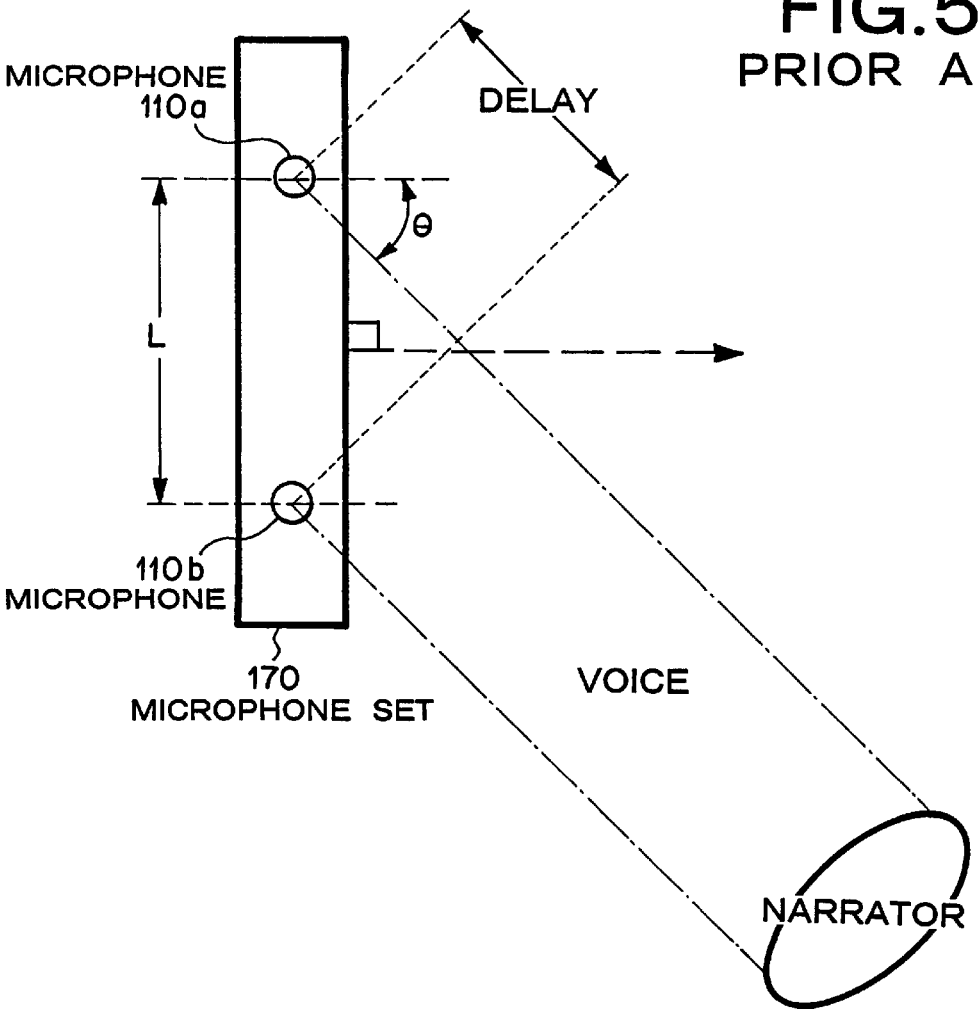
FIG.5 PRIOR ART
FIG. 5 is an illustration for explaining a principle of detecting a direction of a sound source.

FIG. 3 is a flow chart for explaining the operation of voice detection means 250 which distinguishes human voices from background noises. Voice detection means 250 measures the signal level of the outputs from A/D converters 210*a* and 210*b*, during the time period when its timer is set to be zero (step S1). Then, the ratio A (=X/Y) of a signal level X at time "T-1" to a signal level Y at time "T" (step S2).

Then, the ratio A is compared with a prescribed threshold (step S3). When the ratio A is greater than the prescribed level threshold, the step S4 is selected. On the contrary, when the ratio A is not greater than the prescribed level threshold, step S8 is selected. The frequency of the signal for the level comparison may be, for example, about 100 Hz for determining whether the signal picked-up by microphones 110*a* and 110*b* belongs to the frequency range of human voice.

The timer is turned on in step S4. The timer measures the time duration of a sound. Then, the time duration is compared with a prescribed time threshold (step S5). The prescribed time threshold may be, for example, about 0.5 second, because the time threshold is introduced for distinguishing the human voice and the noise such as a sound caused by a participant letting documents fall down.

When the measured time duration is greater than the prescribed time threshold, step S6 is selected. On the contrary, when the measured time duration is not greater than the prescribed time threshold, step S 8 is selected. The sound is determined to be human voice in step S6, while the sound id determined not to be human voice in step 8. Then, step S7 is executed in order to reset the timer or set the timer to be zero. Thus, voice detection means 250 repeats the steps as shown in FIG. 3.

There are seven detection means 260, 260', . . . in an exemplary embodiment as shown in FIG. 2. The detection means detect delays $D_1$ to $D_7$, respectively, which maximizes the integrated mutual correlation coefficients. then, delays $D_1$ to $D_7$ are inputted into delay calculation unit 270 which calculates averaged delay "d".

$$d=D_1 \cdot A_1+D_2 \cdot A_2+D_3 \cdot A_3+D_4 \cdot A_4+D_5 \cdot A_5+D_6 \cdot A_6+D_7 \cdot A_7$$

where A1 to A7 are prescribed coefficients which satisfy the following relation; $A_1+A_2+A_3+A_4+A_5+A_6+A_7=1$.

It is well known that higher frequency components are diffused by a floor and walls, while the lower frequency components are reflected in such a manner that the incident angle added to the reflected angle approaches to 90°, as the frequency becomes low. Therefore, the detection of the narrator direction is affected by the interference between the direct sound and the reflected sound at lower frequency.

Therefore, $A_1<A_2<A_3<A_4<A_5<A_6<A_7$ is preferable, where, for example, $D_1$ is a delay for 50 Hz to 1 kHz, $D_2$ is a delay for 1 kHz to 2 kHz, $D_3$ is a delay for 2 kHz to 3 kHz, $D_4$ is a delay for 3 kHz to 4 kHz, $D_5$ is a delay for 4 kHz to 5 kHz, $D_6$ is a delay for 5 kHz to 6 kHz,and $D_7$ is a delay for 6 kHz to 7 kHz.

Thus, the calculation of the averaged delay "d" is not so much by the interference between the direct sound and the sound reflected by the floor and walls in the lower frequency region.

The averaged delay "d" is inputted into conversion means 280 for converting the averaged delay "d" into the angle of the narrator direction.

The angle of the narrator directionangle θ is equal to $\sin^{-1}(V \cdot d/L)$, where V is speed of sound, L is a microphone distance and "d" is the averaged delay. The angle θ is inputted into driving means 140. Driving means selects either of the output from narrator direction detection means 130 or the output from narrator direction detection means 150 in order to drive rotation means 101.

Rotation means 101 rotates microphone set 160 so that the narrator becomes substantially equidistant from microphones 120*a* and 120*b*. In other words, rotation means 101 turns microphone set 160 toward the sounds source so that the time difference tends to zero. Thus, the microphone set is directed precisely to the direction of the sound source. Therefore, conversion means 280 in microphone set 160 are not always required.

Further, the distances are adjusted more precisely on the basis of the output from narrator direction detection means 150.

Microphone set 170 may be directed to the center of the attendants to the conference, so as to turn microphones quickly, when the narrator is changed. In other words, fixed microphone set 170 is used for turning the rotatable microphone set 160 toward the direction angle θ of the sound source. Therefore, the conversion means is indispensable for microphone set 170.

Video conference apparatus as shown in FIG. 1A may further comprises speakers and display monitors for the voices and images through the other end of the communication lines such as Japanese integrated services digital network (ISDN).

Further, video conference apparatus as shown in FIG. 1A may be used for a video telephone and other image pick-up apparatus for photographing images of sound sources in general.

What is claimed is:

1. A microphone direction set-up apparatus for detecting a sound source and for turning a microphone pair toward said sound source, which comprises:

a rotatable pair of microphones for picking up sound wave from said sound source;

time difference calculation means for calculating a time difference between a time when said sound wave arrives at a microphone and a time when said sound wave arrives at another microphone in said rotatable pair;

rotation means for rotating said rotatable pair on the basis of said time difference, wherein said time difference is an average of time differences in a plurality of frequency ranges; and said rotation means rotates on the basis of said average said rotatable pair toward said sound source so that said average tends to zero.

2. The microphone direction set-up apparatus according to claim 1, wherein:

said average is a summation of time differences in a plurality of frequency ranges multiplied by coefficients prescribed for each of said time differences in a plurality of frequency ranges frequency ranges;

a summation of all of said coefficients is unity; and each of said coefficients decreases as each of said frequency ranges becomes lower.

3. The microphone direction set-up apparatus according to claim 1, which further comprises image pick-up means for picking up an image of an object of said sound source.

4. The microphone direction set-up apparatus according to claim 1, which further comprises:

a fixed pair of microphones for picking up sound wave from said sound source;

time difference calculation means for calculating a time difference between a time when said sound wave arrives at a microphone and a time when said sound wave arrives at another microphone in said fixed pair;

conversion means for converting said time difference into an angle directed to said sound source, wherein:

said time difference is an average of time differences in a plurality of frequency ranges; and said rotation means turns said rotatable pair to a direction defined by said angle.

5. The microphone direction set-up apparatus according to claim 4, wherein:

said average is the summation of said frequency components of said time difference multiplied by coefficients prescribed for each of said frequency range;

a summation of all of said coefficients is unity; and each of said coefficients decreases as said frequency range becomes lower.

6. The microphone direction set-up apparatus according to claim 4, wherein said fixed pair of microphones are directed toward the substantial center of a plurality of sound sources.

* * * * *